US011804674B2

(12) United States Patent
Ma et al.

(10) Patent No.: US 11,804,674 B2
(45) Date of Patent: Oct. 31, 2023

(54) CONTACT MODULE, AND FEMALE CONNECTOR AND MALE CONNECTOR

(71) Applicants: AVIC JONHON OPTRONIC TECHNOLOGY CO., LTD., Luoyangshi (CN); NOKIA SHANGHAI BELL CO., LTD., Shanghai (CN)

(72) Inventors: Lufei Ma, Luoyangshi (CN); Junfeng Yuan, Luoyangshi (CN); Xianjun Pan, Shanghai (CN); Jinhui Fu, Luoyangshi (CN)

(73) Assignees: AVIC JONHON OPTRONIC TECHNOLOGY CO., LTD., Luoyangshi (CN); NOKIA SHANGHAI BELL CO., LTD., Shanghai (CN)

( * ) Notice: Subject to any disclaimer, the term of this patent is extended or adjusted under 35 U.S.C. 154(b) by 334 days.

(21) Appl. No.: 17/251,187

(22) PCT Filed: Jul. 25, 2019

(86) PCT No.: PCT/CN2019/097706
§ 371 (c)(1),
(2) Date: Dec. 10, 2020

(87) PCT Pub. No.: WO2020/020291
PCT Pub. Date: Jan. 30, 2020

(65) Prior Publication Data

US 2021/0226386 A1 Jul. 22, 2021

(30) Foreign Application Priority Data

Jul. 27, 2018 (CN) ..... 201810847127.5

(51) Int. Cl.
*H01R 13/6471* (2011.01)
*H01R 13/05* (2006.01)
(Continued)

(52) U.S. Cl.
CPC ..... *H01R 13/6471* (2013.01); *H01R 13/05* (2013.01); *H01R 13/11* (2013.01); *H01R 13/652* (2013.01); *H01R 13/6585* (2013.01)

(58) Field of Classification Search
CPC .... H01R 13/6471; H01R 13/05; H01R 13/11; H01R 13/652; H01R 13/6597;
(Continued)

(56) References Cited

U.S. PATENT DOCUMENTS 6,780,059 B1 8/2004 Payne
7,695,289 B1 * 4/2010 Sato ..... H01R 13/11 439/78
(Continued)

FOREIGN PATENT DOCUMENTS

CN 2458758 Y 11/2001
CN 104300313 A 1/2015
(Continued)

OTHER PUBLICATIONS

Office Action issued in Chinese Application No. 201810847127.5, dated Dec. 26, 2019; 17 pgs.
(Continued)

*Primary Examiner* — Marcus E Harcum
(74) *Attorney, Agent, or Firm* — HAUPTMAN HAM, LLP

(57) ABSTRACT

A contact module, a female connector and a male connector, wherein the female contact unit of the female connector includes signal contacts arranged in pairs and ground contacts corresponding to the signal contacts, a side surface of each signal contact facing the corresponding ground contact
(Continued)

includes a signal contact portion in conductive contact with the signal contact portion of an adapter connector, a side surface of each ground contact facing the corresponding signal contact includes a shielding contact portion in electrical contact with the ground contact of the adapter connector, and a plugging space for plugging the contact module of the adapter connector is between the signal contacts and the ground contacts. The female connector enables the adapted contact unit to be clamped between the corresponding signal contact and the corresponding ground contact to realize corresponding conduction.

6 Claims, 5 Drawing Sheets

(51) Int. Cl.
*H01R 13/11* (2006.01)
*H01R 13/652* (2006.01)
*H01R 13/6585* (2011.01)

(58) Field of Classification Search
CPC ..... H01R 13/6586; H01R 13/6587; H01R 13/6585; H01R 13/6582
USPC ..... 439/108, 607.5, 607.8, 607.9
See application file for complete search history.

(56) References Cited

U.S. PATENT DOCUMENTS 7,985,079 B1 * 7/2011 Wilson ..... H01R 31/06 439/74
9,017,103 B2 * 4/2015 Davis ..... H01R 12/716 439/607.1
9,356,401 B1 * 5/2016 Horning ..... H01R 13/6587
9,401,569 B2 * 7/2016 Davis ..... H01R 13/6585
9,407,045 B2 * 8/2016 Horning ..... H01R 13/6585
9,455,534 B2 * 9/2016 Resendez ..... H01R 13/658
9,531,133 B1 * 12/2016 Horning ..... H01R 13/6477
9,543,676 B2 * 1/2017 Evans ..... H01R 13/6587
9,608,388 B2 * 3/2017 Kondo ..... H01R 24/38
10,128,616 B2 * 11/2018 Morgan ..... H01R 13/424
10,498,100 B1 * 12/2019 Trout ..... H01R 13/6587
10,714,854 B2 * 7/2020 Peng ..... H01R 13/187
10,873,142 B2 * 12/2020 Goh ..... H01R 12/7082
11,444,398 B2 * 9/2022 Stokoe ..... H01R 12/716
2011/0279140 A1 * 11/2011 Uesaka ..... H01R 12/714 439/55
2012/0252271 A1 * 10/2012 Pan ..... H01R 13/6586 439/607.01
2013/0189866 A1 * 7/2013 Wagata ..... H01R 13/422 439/246
2014/0017950 A1 * 1/2014 Peloza ..... H01R 13/6471 439/629
2018/0034175 A1 * 2/2018 Lloyd ..... H01R 24/60

FOREIGN PATENT DOCUMENTS

CN 104348011 A 2/2015
CN 105531875 A 4/2016
CN 106169669 A 11/2016
CN 109659740 A 4/2019

OTHER PUBLICATIONS

First Search Report issued in Chinese Application No. 201810847127.5, dated Dec. 16, 2019; 1 pg. (in English only).
International Search Report issued in corresponding International Application No. PCT/CN2019/097706; dated Oct. 24, 2019; State Intellectual Property Office of the P.R. China, Beijing, China, 6 pgs.
Written Opinion issued in corresponding International Application No. PCT/CN2019/097706; dated Oct. 24, 2019; State Intellectual Property Office of the P.R. China, Beijing, China, 8 pgs.

* cited by examiner

CONTACT MODULE, AND FEMALE CONNECTOR AND MALE CONNECTOR

RELATED APPLICATIONS

The present application is a National Phase of International Application Number PCT/CN2019/097706 filed Jul. 25, 2019 and claims priority to Chinese Application Number 201810847127.5 filed Jul. 27, 2018.

TECHNICAL FIELD

The present invention relates to high-speed connectors, and in particular, to a contact module, a female connector and a male connector.

BACKGROUND ART

With the development trend of miniaturization, densification and integration, the application of high-speed differential connectors becomes more and more extensive. Due to the large number of transmitted signals, a high-speed differential connector is generally provided with a shielding structure for shielding each signal transmission circuit so as to avoid crosstalk between adjacent signal transmission circuits. Existing are various types of high-speed differential connectors. In a relatively common connector, for example, a fully shielded differential connector disclosed in the present application of CN 104300313A, the differential pairs are arranged in a row, ground contacts are arranged between every two adjacent differential pairs, wiring shielding members are arranged between every two adjacent differential pairs, and during plugging, the differential pairs and the ground contacts are attached on the same side to the differential pairs and the ground contacts of an adapter connector are. This differential connector has a high degree of integration and is widely used.

However, when applied to a vibration environment or a plugging position requiring certain offset, the above connector tends to cause uneven stress at the plugging part by adopting single-sided contact and accordingly affect the transmission performance of the connector. Furthermore, all the contact modules are elastically attached to one another through the same side to cause that the entire connector is subjected to the lateral force from the same direction when being plugged and thereby bears high plugging resistance.

SUMMARY OF THE INVENTION

An object of the present invention is to provide a female connector and a male connector which are adapted to each other, so as to solve the problem that plug-in modules bearing single-sided elastic stress are affected in transmission performance and high in plugging resistance; meanwhile, the present invention also provides a side clamping contact module included in the female connector and the male connector.

A female connector comprises a connector housing; a female contact unit is mounted in the connector housing; the female contact unit comprises female signal contacts arranged in pairs and female ground contact arranged corresponding to the female signal contact arranged in pairs; one end of each female contact unit is a socket end; at the socket end, the female ground contacts arranged in pairs and the female signal contacts arranged in pairs form an elastic clamping structure; a plugging space for plugging a male contact unit is formed between the female signal contacts and the female ground contacts; a female signal contact portion is arranged on one side of each female signal contact facing the corresponding female ground contact for elastically abutting against the corresponding male signal contact of a male contact unit which are provided with the male signal contacts arranged in pairs and male ground contacts arranged in pairs; a female shielding contact portion is arranged on one side of each female ground contact facing the corresponding female signal contact for elastically abutting against the corresponding male ground contact of the male contact unit which are provided with the male signal contacts arranged in pairs and the male ground contacts arranged in pairs.

In the female connector of the present invention, the male contact unit is elastically clamped in the middle by the female signal contact and the female ground contact and correspondingly conducted, so that the contact modules of the two connectors adapted in the plugging position bear interaction forces on both sides, and even during application on occasions with vibration or certain plugging offset, vibration displacement or plugging offset can be compensated by the elastic deformation of the elastic clamping structure to improve the contact reliability of the plugging position and the performance be more reliable.

Further, at least one of each female signal contact portion and the corresponding female shielding contact portion is disposed on the elastic overhung segment of the corresponding contact to achieve elastic abutment with an adaptor. Therefore, the structure is simple and the processing cost is low.

Improvement is further performed on the basis and is that the female contact unit further comprises a unit insulator, a pair of female signal contacts are mounted in the unit insulator, each female ground contact comprises a cylindrical shielding shell circumferentially wrapping the unit insulator, elastic overhung segments on each female signal contact extend out of two ends of the cylindrical shielding shell and are located at the end openings of the cylindrical shielding shell. Since the elastic overhung segments are subjected to lateral force, the elastic overhung segments of the ground contacts can be arranged on the cylindrical shielding shells wrapping the insulator so as to ensure reliable connection between the shielding shells and the insulator.

Of course, in order to facilitate the processing, the cylindrical shielding shells are formed by winding a material strip and then lapping two ends of the material strip.

In addition, the female contact unit further includes a unit insulator, a pair of female signal contacts and corresponding female ground contacts are fixed to the unit insulator to form a female contact module, and a plurality of the female contact modules are mounted in the connector housing. The contact unit is configured to be formed by modules, thereby achieving modularization and convenient disassembly and assembly.

The male connector of the present invention comprises a connector housing, a male contact unit is mounted in the connector housing, the male contact unit comprises male signal contacts arranged in pairs and male ground contacts arranged corresponding to the male signal contacts arranged in pairs, one end of the male contact unit is a plug end plugged into the plugging space of the female connector when in use, at the plug end, one side of each male signal contact away from the corresponding male ground contact is provided with a male signal contact portion for elastically abutting against the corresponding female signal contact of the female contact unit which are provided with the female signal contacts arranged in pairs and the female ground contacts arranged in pairs, and one side of each male ground contact away from the corresponding male signal contact is provided with a male shielding contact portion for conductive contact with the corresponding female ground contact of the female contact unit which are provided with the female signal contacts arranged in pairs and the female ground contacts arranged in pairs.

When the male connector of the present invention is in use, the male contact unit is clamped in the plugging space of the female contact unit, so that the contact modules of the two connectors adapted in the plugging position bear interaction forces on both sides, and even during application on occasions with vibration or certain plugging offset is used, the contact reliability of the plugging position can be improved and the performance be more reliable.

Further, the male contact unit further comprises a unit insulator at the plug end, the unit insulator is provided with an insulating support portion arranged between the male signal contacts and the male ground contacts for providing support when the male signal contacts and the male ground contacts of the male contact unit elastically abut against the female signal contacts and the female ground contacts, so as to ensure reliable contact of the signal contacts and the ground contacts when adapted contacts elastically abut.

Further, a pair of male signal contacts and the corresponding male ground contacts are fixed to the unit insulator to form a male contact module, and a plurality of the male contact modules are mounted in the connector housing. The contact unit is configured to be formed by a module, thereby achieving modularization and convenient disassembly and assembly.

Specifically, at the plug end, the male ground contacts are of a U-shaped structure and half-enclose a signal pair, the insulating support portion is filled in the inner groove of a U-shaped shielding piece and exposes a side surface of the signal pair facing the notch, and the male signal contact portion is located on the exposed side surface. Therefore, two side edges of the U-shaped portion of each ground contact can achieve certain shielding effects on the signal contacts therein, and the shielding effects can be good.

Meanwhile, optimization design is further performed and is that each male ground contact comprises a cylindrical shielding shell circumferentially wrapping unit insulator, and the U-shaped ground contact at the plug end and the cylindrical shielding shell are of an integral structure.

The female contact module of the present invention comprises an insulator, female signal contacts and female ground contacts are fixedly arranged in pairs on the insulator, one end of the female contact unit is a socket end at which the female ground contacts are arranged in pairs with the female signal contacts arranged in pairs to form an elastic clamping structure, a plugging space for plugging a male contact unit is provided between the female signal contact and the female ground contact, one side of each female signal contact facing the female ground contact is provided with a female contact portion for elastically abutting against the corresponding male signal contact of the male contact unit which are provided with male signal contacts arranged in pairs and male ground contacts arranged in pairs, and one side of each female ground contact facing the female signal contact is provided with a female shielding contact portion for elastically abutting against the corresponding male ground contact of the male contact unit which are provided with the male signal contacts arranged in pairs and the male ground contacts arranged in pairs.

In the present invention, the female connector enables the adapted male contact unit to be clamped between the female signal contacts and the female ground contacts and realizes corresponding conduction, so that the contact modules of the two connectors adapted in the plugging position bear interaction forces on both sides, and even during application on occasions with vibration or certain plugging offset, vibration displacement or plugging offset can be compensated by elastic deformation of the elastic clamping structure, so as to improve the contact reliability of the plugging position and the performance be more reliable.

Further, at least one of each female signal contact portion and the corresponding female shielding contact portion is disposed on the elastic overhung segment of the corresponding contact to achieve elastic abutment with the adaptor. Therefore, the structure is simple and the processing cost is low.

Improvement is further performed on the basis, the female contact unit further comprises a unit insulator, a pair of female signal contacts are mounted in the unit insulator, each female ground contact comprises a cylindrical shielding shell circumferentially wrapping the unit insulator, and elastic overhung segments on the female signal contacts extends out of two ends of the cylindrical shielding shell and elastic overhanging segments of the female ground contact are located at the end openings of the cylindrical shielding shell. Since the elastic overhung segment is subjected to lateral force, the elastic overhung segments of the ground contacts can be arranged on the cylindrical shielding shells wrapping the insulator, so as to ensure reliable connection between the shielding shells and the insulator.

Of course, in order to facilitate the processing, the cylindrical shielding shells are formed by winding a material strip and then lapping two ends of the material strip.

In addition, the female contact unit further includes a unit insulator, a pair of female signal contacts and corresponding female ground contacts are fixed to the unit insulator to form a female contact module, and a plurality of the female contact modules are mounted in the connector housing. The contact unit is configured to be formed by modules, thereby achieving modularization and convenient disassembly and assembly.

The male contact module of the present invention comprises an insulator, a pair of male signal contacts and a male ground contact are fixed on the insulator, and the male ground contact and the paired male signal contacts are arranged in pairs, one end of the male signal contacts and the male ground contacts is a plug end plugged into the plugging space of the female connector when in use, at the plug end, one side of each male signal contact away from the corresponding male ground contact is provided with a male signal contact portion for conductive contact with the corresponding female signal contact of the female contact unit which are provided with the female signal contacts arranged in pairs and the female ground contacts arranged in pairs, and one side of each male ground contact away from the corresponding male signal contact is provided with a male shielding contact portion for conductive contact with the corresponding female ground contact of the female contact unit which is provided with the female signal contacts arranged in pairs and the female ground contacts arranged in pairs.

When the male connector of the present invention is in use, the male contact unit is clamped in the plugging space of the female contact unit, so that the contact modules of the two connectors adapted in the plugging position bear interaction forces on both sides, and even during application on occasions with vibration or certain plugging offset, the contact reliability of the plugging position can be improved and the performance be more reliable.

Further, at the plug end, the insulator is provided with an insulating support portion between the male signal contacts and the male ground contacts for providing support when the male signal contacts and the male ground contacts of the male contact unit elastically abut against the female signal contacts and the female ground contacts of the female connector, so as to ensure reliable contact of the male signal contacts and the male ground contacts when adapted contacts elastically abut.

Further, the male ground contacts are of a U-shaped structure and half-enclose a signal pair, the insulating support portion is filled in the inner groove of the U-shaped shielding piece and exposes a side surface of the signal pair facing the notch, and the male signal contact portion is located on the exposed side surface. Therefore, two side edges of the U-shaped portion of each ground contact can achieve certain shielding effects on the signal contact therein, and the shielding effects are good.

Meanwhile, optimization design is further performed and is that each male ground contact comprises a cylindrical shielding shell circumferentially wrapping the unit insulator, and the U-shaped ground contact at the plug end and the cylindrical shielding shell are of an integral structure.

Figure 1:
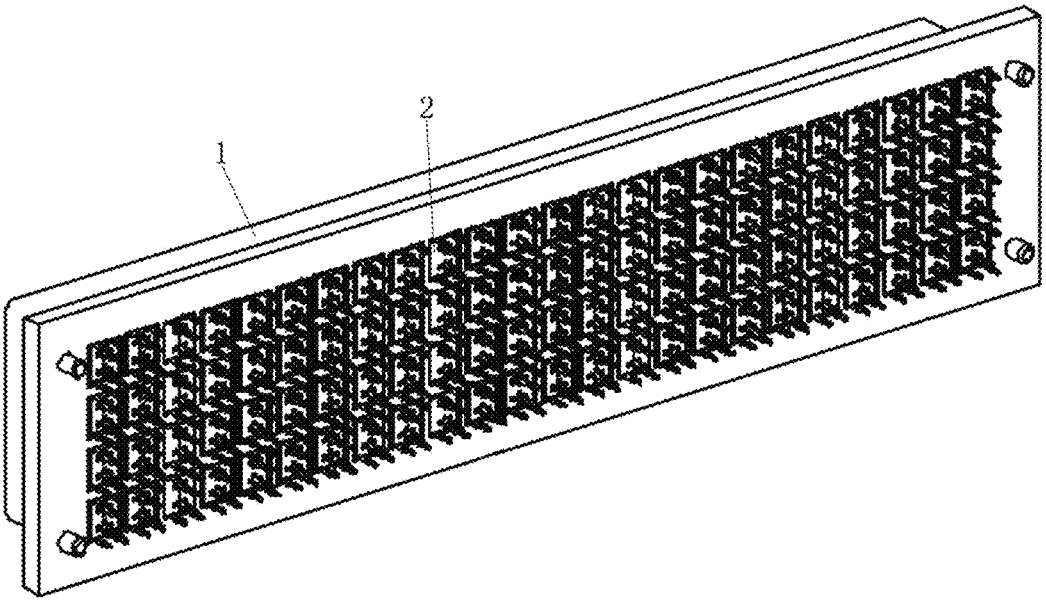
FIG. 1 is a schematic structural diagram of a female connector according to the present invention.
Figure 2:
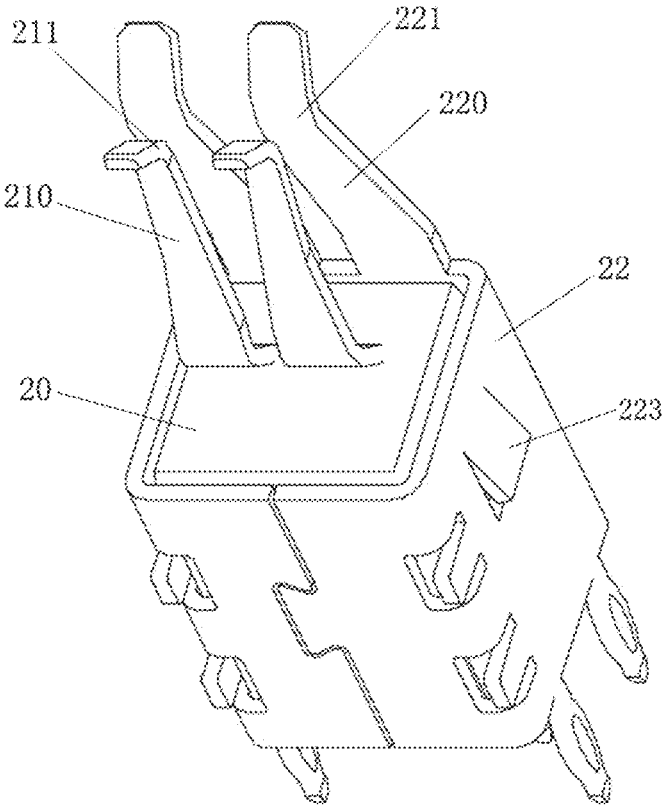
FIG. 2 is a schematic structural diagram of a female contact module according to the present invention.
Figure 3:
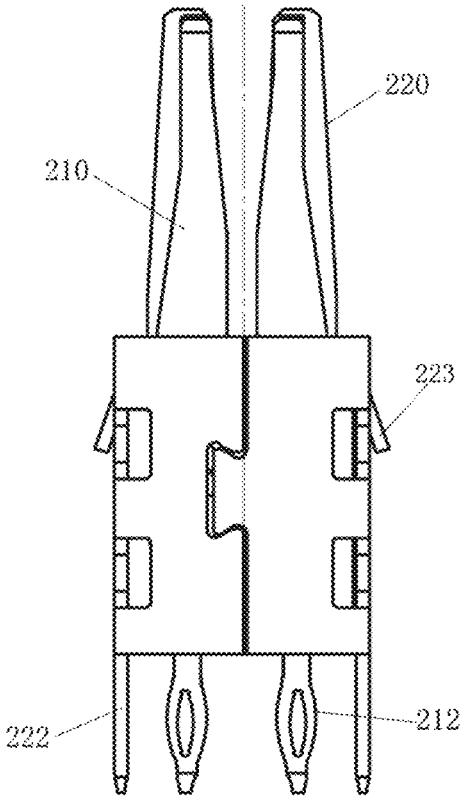
FIG. 3 is a front view of the female contact module.
Figure 4:
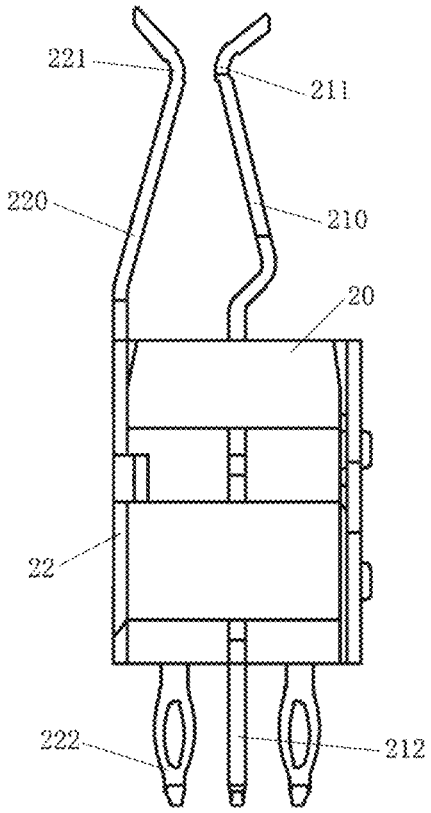
FIG. 4 is a left view of FIG. 3.

In the figure: 1—female end housing; 2—female contact module; 20—female end module insulator; 210—signal overhung segment; 211—female signal contact portion; 212—fisheye structure; 22—female end ground shielding shell; 220—ground overhung section; 221—female shielding contact portion; 222—ground fisheye; 223—barb-shaped structure; 3—male end housing; 4—male contact module; 40—unit insulator; 41—male signal contact; a 42—male end ground shielding shell; 420—male end ground overhung segment; 44—insulating support portion.

DESCRIPTION OF EMBODIMENTS

The embodiments of the present invention will be further described below with reference to the accompanying drawings.

As shown in FIGS. 1-7, an embodiment of the female connector of the present invention comprises a female end housing 1, a plurality of mounting grooves are formed in the female end housing 1, female contact modules 2 are mounted in the mounting grooves, each female contact module 2 comprises a female end module insulator 20, female signal contacts arranged in pairs are mounted in the female end module insulator 20, the female contact module further comprises female ground contacts, each female ground contact comprises a female ground shielding housing 22 wrapping outside the female end module insulator 20, and the female signal contacts extend out of the female end module insulator 20 from the end openings of the female end ground shielding housing 22. The female end ground shielding housing 22 is fixed relatively to the female end housing 1 by a barb structure 223 provided thereon. One end of each female signal contact extending out of the female module insulator 20 is a terminal which is specifically a fisheye structure 212 used for connecting a printed board in this embodiment, and the other end is a signal overhung segment 210. A ground overhung segment 220 is provided on the female shielding housing 22 on a side opposite to (not limited to directly opposite to) the female signal contact, and a ground fish-eye 222 is provided on the other end. The signal overhung segment and the ground overhung segment form a plugging segment, the side surface of each female signal contact facing the female ground contact is provided with a female signal contact portion 211 for conductive contact with the male contact unit, the side surface of each female ground contact facing the female signal contact is provided with a female shielding contact portion 221 for conductive contact with the corresponding male ground contact, and the space in the elastic clamping opening which is formed by the signal overhung segment and the ground overhung segment serves as a plugging space for plugging a male contact module.

Figure 5:
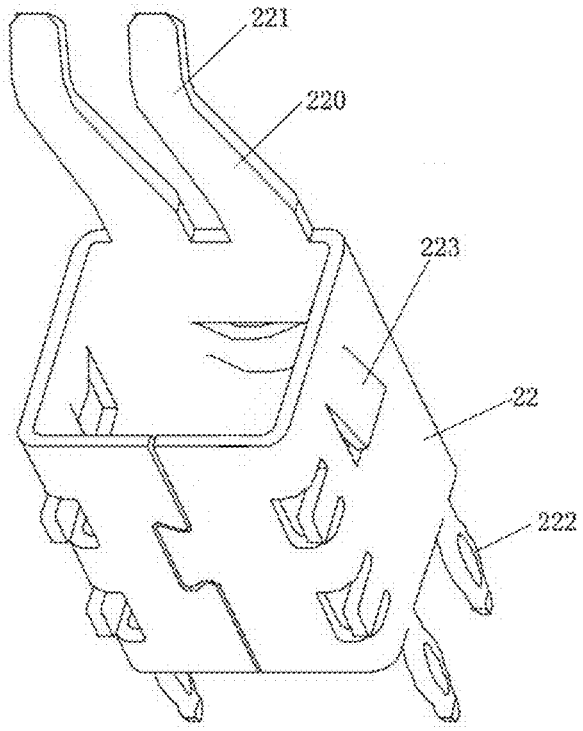
FIG. 5 is a schematic structural diagram of a ground contact of the female contact module.
Figure 6:
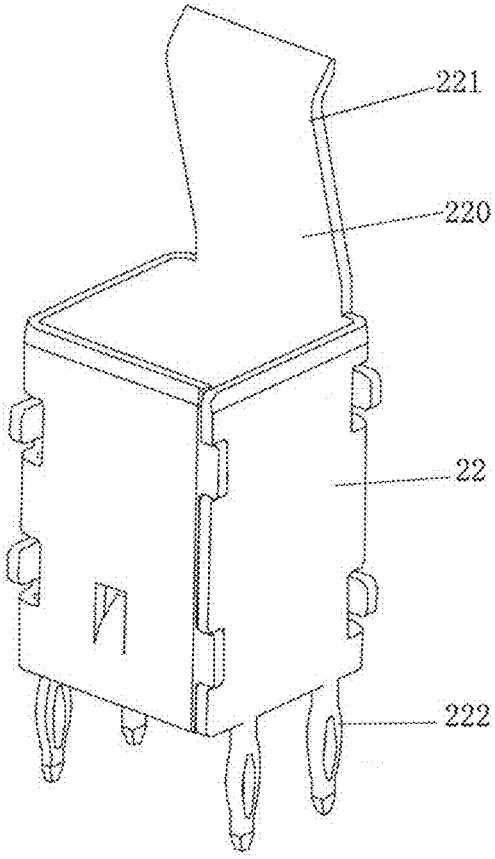
FIG. 6 is a schematic structural diagram of a ground contact of another female contact module.
Figure 7:
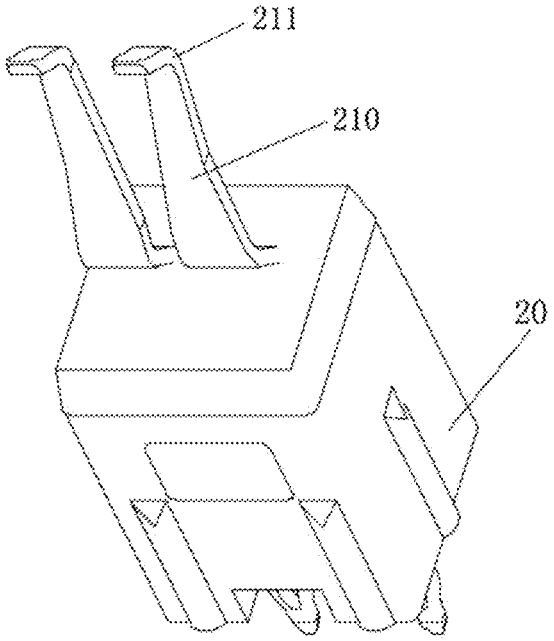
FIG. 7 is a schematic diagram of a combination of an insulator and a signal contact of the female contact module.

Various structures of the female ground contact are shown as in FIG. 5 and FIG. 6 respectively which provide two different forms. In FIG. 5, the ground overhung segment 220 extending from the shielding shell of the female ground contact is an integral overhung piece, while In FIG. 6, the ground overhung segment 220 extending from the shielding shell of the female ground contact are split overhung arms, and the two split overhung arms are substantially opposite to the two signal overhung segments. Of course, in other embodiments, the female ground contact may be of an elongated chip structure, namely not including the ground shielding housing structure wrapping the female end module insulator in the above-mentioned embodiment.

In addition, in other embodiments, a part of the female signal contacts and the female ground contacts of the female connector are mounted in the same insulator, for example, the same row of contact units are arranged in one insulator, or all of the female signal contacts and all the female ground contacts are mounted in the same insulator, namely without adopting a modular mounting mode.

Figure 8:
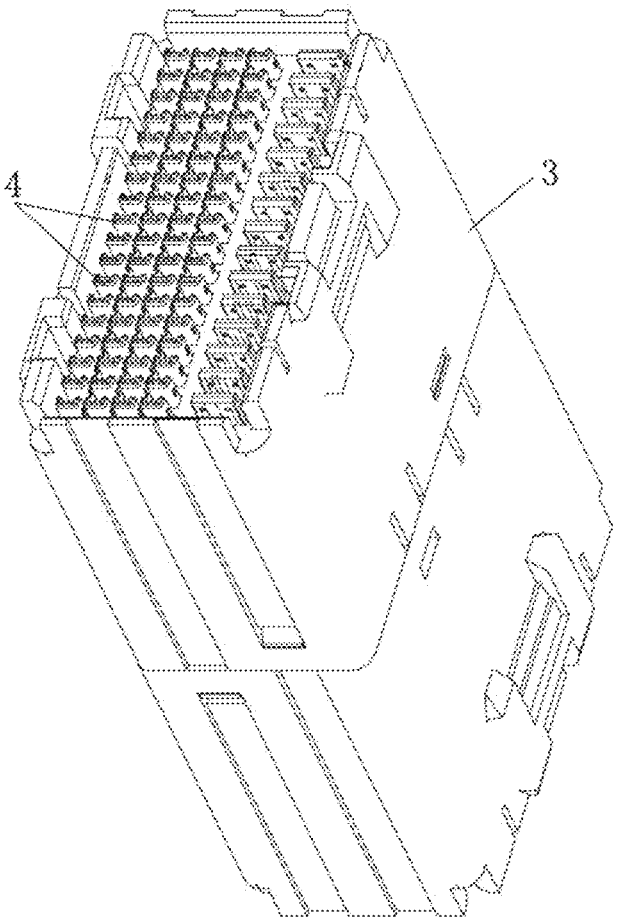
FIG. 8 is a schematic structural diagram of a male connector.
Figure 9:
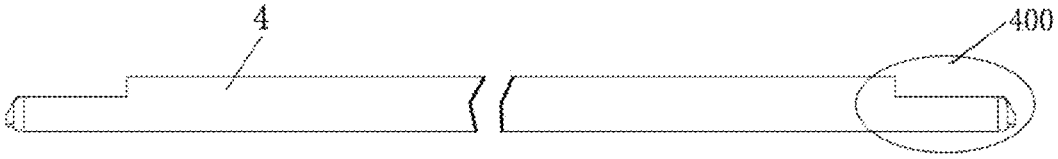
FIG. 9 is a schematic structural diagram of a male contact module.
Figure 10:
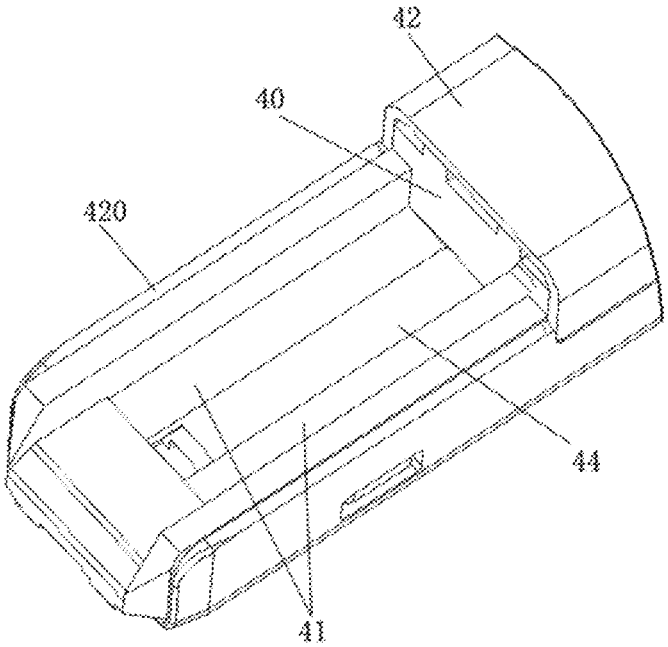
FIG. 10 is a schematic diagram of the plugging position shown in FIG. 9.

The male connector of the present invention is shown in FIGS. 8, 9 and 10, and in the embodiment takes an adapter connector as an example, and of course in other embodiments can be a single-end plugged plug or a socket connector. the male connector comprises a male end housing 3, a plurality of mounting grooves are form in the male end housing 3, male contact modules 4 are mounted in the mounting grooves, each male contact module 4 comprises a unit insulator 40, male signal contacts 41 arranged in pairs are mounted in the unit insulator 40, each male contact module 4 further comprises a male ground contact, each male ground contact comprises a male end ground shielding housing 42 wrapping outside the unit insulator 40, and the male signal contacts 41 extend out of the two end openings of the male end ground shielding housing 42. Both ends of the male contact module are plug ends, and both ends of each male signal contact 41 extending out of the unit insulator 40 are plugging portions for plugging the female connector. Of course, in other embodiments, the male ground contacts may be of an elongated strip structure, namely not including the ground shielding housing structure wrapping the male module insulator in the above-mentioned embodiment.

The male end ground shielding housing 42 is integrally provided with a male end ground overhung segment 420 on a side opposite to the plugging portions of the male signal contacts 41, and the male end ground overhung segment 420 is used for being plugged into the female contact module.

Figure 11:
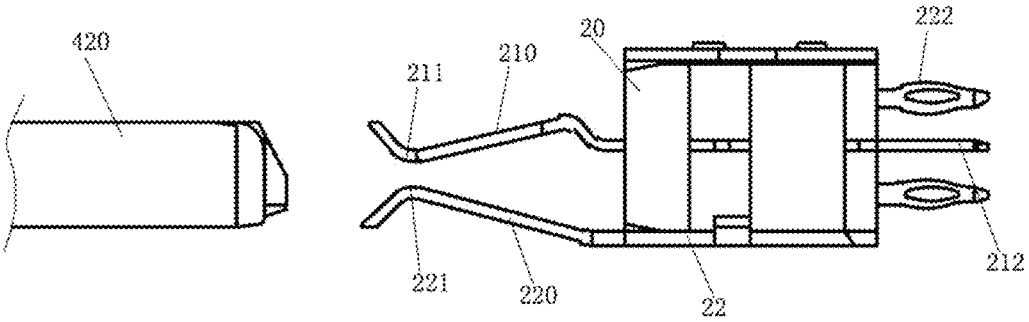
FIG. 11 is a schematic diagram of the plugging process of the female contact module and the male contact module.

As shown in FIG. 11, at the plug end, the side surface of the male signal contact away from the male ground contact is provided with a male signal contact portion for conductive contact with the corresponding female signal contact, and the side surface of the male ground contact away from the male signal contact of the male end ground overhung segment 420 is provided with a male shielding contact portion for conductive contact with the corresponding female ground contact.

In the present embodiment, at the plug end, the unit insulator 40 is provided with an insulating support portion 44 between the male signal contacts and the male ground contacts for providing support when the male signal contacts and the male ground contacts elastically abut against the female signal contacts and the female ground contacts respectively, so as to ensure reliable contact between the male signal contacts and the male ground contacts when adapted contacts elastically abut.

In addition, at the plug end, the male end ground overhung segment 420 is of a U-shaped structure and half-encloses a pair of male signal contacts, the insulating support portion 44 is filled in the inner groove of the U-shaped shielding piece and exposes the side surface of the signal pair facing the notch, and the male signal contacts are located on the exposed side surface. Therefore, two side edges of the male end ground overhung segment 420 of the U-shaped structure can achieve certain shielding effects on the male signal contacts therein, and the shielding effects can be good.

Of course, the male connector of the present invention is not limited to the above-mentioned embodiments, but in other embodiments, the male end ground overhung segment may be of a flat board structure; the insulating support portion may not be provided between the male ground overhung segment and the plug end of the male signal contacts, so that both can be of a free overhung structure. In this case, the male signal contacts and the male ground contacts may be in contact with the adapted female contacts through their own overhanging elasticity, and correspondingly, the socket end of the female signal contacts and the female ground contacts may be fixed relative to the insulator.

Furthermore, in other embodiments, a part of the male signal contacts and male ground contacts may also be mounted in the same insulator, for example, the same row of contact units are arranged in one insulator, or all male signal contacts and male ground contacts are mounted in the same insulator, namely without a modular mounting mode.

A variety of embodiments of the female connector and the male connector are provided above, respectively, wherein at the plug and socket ends and in the insulator, both the male and female ground contacts and the male and female signal contacts of are all arranged in pairs and spaced from each other, while in other embodiments, the ground contacts and the signal contacts can be arranged opposite to and spaced from each other only at the plug and socket ends, but can be located on the same plane in the insulator.

Based on the foregoing various embodiments of the female and male connectors, the present invention further provides embodiments of a female contact module and a male contact module, of which the specific structures are the same to that of the contact modules in the foregoing female and the male connectors, and are not described herein.

When the female and male connectors of the present invention are adapted in a plugging mode, the plug end of the contact module of the male connector is clamped in the plugging space formed by the socket end of the female contact module, so that the contact pieces of the two connectors adapted at the plugging position bear interaction forces on both sides, and even during application on occasions with vibration or certain plugging offset, the contact reliability of the plugging position can be improved and the performance be more reliable.

The invention claimed is:

1. A female connector, comprising a connector housing internally provided with a female contact unit, and characterized in that the female contact unit comprises female signal contacts which are arranged in pairs and female ground contacts which are arranged corresponding to the female signal contacts arranged in pairs, one end of each female contact unit is a socket end at which the female ground contacts and the female signal contacts arranged in pairs are arranged in pairs to form an elastic clamping structure, a plugging space for plugging a male contact unit is formed between the female signal contacts and the female ground contacts, and a female signal contact portion is arranged on one side of each female signal contact facing the corresponding female ground contact for elastically abutting against the corresponding male signal contact of the male contact unit which are provided with the male signal contacts arranged in pairs and male ground contact; one side of each female ground contact facing the female signal contact is provided with a female shielding contact portion, which is used for elastically abutting against the corresponding male ground contact of the male contact unit which are provided with the male signal contacts arranged in pairs and the male ground contact; at least one of each female signal contact portion and the corresponding female shielding contact portion is disposed on an elastic overhung segment of the corresponding contact to achieve elastic abutment with an adaptor; the female contact unit further comprises a unit insulator, a pair of the female signal contacts are mounted in the unit insulator, each female ground contact comprises a cylindrical shielding shell circumferentially wrapping the unit insulator, and the elastic overhung segments on each female signal contact extend out of two ends of the cylindrical shielding shell and are located at end openings of the cylindrical shielding shell; the cylindrical shielding shells are formed by winding a material strip and then lapping two ends of the material strip.

2. The female connector according to claim 1, characterized in that the female contact unit further comprises a unit insulator, a pair of the female signal contacts and the corresponding female ground contacts are fixed to the unit insulator to form a female contact module, and a plurality of the female contact modules are mounted in the connector housing.

3. A male connector, comprising a connector housing in which a male contact unit is mounted, and characterized in that the male contact unit comprises male signal contacts arranged in pairs and male ground contacts arranged corresponding to the male signal contacts arranged in pairs, and one end of the male contact unit is a plug end which is plugged into a plugging space of a female connector when in use, at the plug end, one side of each male signal contact away from the corresponding male ground contact is provided with a male signal contact portion for elastically abutting against a corresponding female signal contact of a female contact unit which are provided with female signal contacts arranged in pairs and female ground contacts arranged in pairs, and one side of each male ground contact away from the male signal contact is provided with a male shielding contact portion for conductive contact with the corresponding female ground contact of the female contact unit which are provided with the female signal contacts arranged in pairs and the female ground contacts arranged in pairs; the male contact unit further comprises a unit insulator, and at the plug end, the unit insulator is provided with an insulating support portion arranged between the male signal contacts and the male ground contacts for providing support when the male signal contacts and the male ground contacts of the male contact unit elastically abut against the female signal contacts and the female ground contacts; a pair of the male signal contacts and the corresponding male ground contacts are fixed to the unit insulator to form a male contact module, and a plurality of the male contact modules are mounted in the connector housing; at the plug end, the male ground contacts are of a U-shaped structure and half-enclose the male signal contacts, the insulating support portion is filled in an inner groove of a U-shaped shielding piece and exposes a side surface of the signal pair facing a notch, and the male signal contact portion is located on an exposed side surface; each male ground contact comprises a cylindrical shielding shell circumferentially wrapping the unit insulator, and the U-shaped ground contact at the plug end and the cylindrical shielding shell are of an integral structure.

4. A female contact module, characterized by comprising an insulator which is fixedly provided with female signal contacts arranged in pairs and female ground contacts arranged in pairs, one end of each female contact unit is a socket end at which, the female ground contacts are arranged in pairs with the female signal contacts arranged in pairs to form an elastic clamping structure, a plugging space for plugging a male contact unit is arranged between the female signal contact and the female ground contact, one side of each female signal contact facing the female ground contact is provided with a female signal contact portion for elastically abutting against a corresponding male signal contact of the male contact unit which are provided with male signal contacts arranged in pairs and male ground contact, and one side of each female ground contact facing the corresponding female signal contact is provided with a female shielding contact portion for elastically abutting against the corresponding male ground contact of the male contact unit which are provided with the male signal contacts arranged in pairs and the male ground contact; at least one of each female signal contact portion and the corresponding female shielding contact portion is disposed on the elastic overhung segment of the corresponding contact to achieve elastic abutment with an adaptor; the female contact unit further comprises a unit insulator, a pair of female signal contacts are mounted in the unit insulator, each female ground contact comprises a cylindrical shielding shell circumferentially wrapping the unit insulator, and elastic overhung segments on each female signal contact extend out of two ends of the cylindrical shielding shell and elastic overhanging segments of the female ground contact are located at the end openings of the cylindrical shielding shell; the cylindrical shielding shells are formed by winding a material strip and then lapping two ends of the material strip.

5. The female contact module according to claim 4, characterized in that the female contact unit further comprises a unit insulator, a pair of female signal contacts and corresponding female ground contacts are fixed to the unit insulator to form a female contact module, and a plurality of female contact modules are mounted in the connector housing.

6. A male contact module, characterized by comprising an insulator, a pair of male signal contacts and a male ground contact are fixed on the insulator, and the male ground contact and the paired male signal contacts are arranged in pairs, one end of the male signal contacts and the male ground contact is a plug end plugged into the plugging space of a female connector when in use, and at the plug end, one side of each male signal contact away from the male ground contact is provided with a male signal contact portion for conductive contact with the corresponding female signal contact of the female contact unit which are provided with the female signal contacts arranged in pairs and the female ground contacts arranged in pairs, and one side of each male ground contact away from the corresponding male signal contact is provided with a male shielding contact portion that makes conductive contact with the corresponding female ground contact of the female contact unit which are provided with the female signal contacts arranged in pairs and the female ground contacts arranged in pairs; at the plug end, the insulator is provided with an insulation support portion disposed between the male signal contacts and the male ground contacts for providing support when the male signal contacts and the male ground contacts of the male contact unit elastically abut against the female signal contacts and the female ground contacts of the female connector; at the plug end, the male ground contacts are of a U-shaped structure and half-enclose a signal pair, the insulating support portion is filled in the inner groove of the U-shaped shielding piece and exposes a side surface of the signal pair facing the notch, and the male signal contact portion is located on the exposed side surface; each male ground contact comprises a cylindrical shielding shell circumferentially wrapping the unit insulator, and the U-shaped ground contact at the plug end and the cylindrical shielding shell are of an integral structure.

* * * * *